US007573253B2

(12) United States Patent
Lestician

(10) Patent No.: US 7,573,253 B2
(45) Date of Patent: Aug. 11, 2009

(54) SYSTEM FOR MANAGING ELECTRICAL CONSUMPTION

(75) Inventor: Guy J. Lestician, East Stroudsburg, PA (US)

(73) Assignee: DMI Manufacturing Inc., East Stroudsburg, PA (US)

( * ) Notice: Subject to any disclaimer, the term of this patent is extended or adjusted under 35 U.S.C. 154(b) by 603 days.

(21) Appl. No.: 11/489,082

(22) Filed: Jul. 19, 2006

(65) Prior Publication Data

US 2007/0024264 A1 Feb. 1, 2007

Related U.S. Application Data

(60) Provisional application No. 60/703,441, filed on Jul. 29, 2005.

(51) Int. Cl.
*H01F 27/42* (2006.01)

(52) U.S. Cl. ..... 323/356

(58) Field of Classification Search ..... 323/355–363
See application file for complete search history.

(56) References Cited

U.S. PATENT DOCUMENTS

| | | | | |
|---|---|---|---|---|
| 3,786,338 | A * | 1/1974 | Gilbert | 323/359 |
| 4,163,218 | A | 7/1979 | Wu | |
| 4,845,580 | A | 7/1989 | Kitchens | |
| 4,870,528 | A | 9/1989 | Harford | |
| 5,105,327 | A | 4/1992 | Wohlforth | |
| 5,420,741 | A | 5/1995 | Ushiyama et al. | |
| 5,432,710 | A | 7/1995 | Ishimaru et al. | |
| 5,436,513 | A | 7/1995 | Kay et al. | |
| 5,459,459 | A | 10/1995 | Lee, Jr. | |
| 5,462,225 | A | 10/1995 | Massara et al. | |
| 5,483,672 | A | 1/1996 | Sasuta | |
| 5,495,129 | A | 2/1996 | Schou et al. | |
| 5,512,831 | A | 4/1996 | Cisar et al. | |
| 5,517,188 | A | 5/1996 | Carroll et al. | |
| 5,528,123 | A | 6/1996 | Hutchison | |
| 5,640,314 | A | 6/1997 | Glasband et al. | |
| 5,646,458 | A | 7/1997 | Bowyer et al. | |
| 5,880,677 | A | 3/1999 | Lestician | |
| 5,892,667 | A | 4/1999 | Glasband et al. | |
| 6,009,004 | A | 12/1999 | Swamy | |
| 6,014,017 | A | 1/2000 | Weinhold et al. | |
| 6,058,035 | A | 5/2000 | Madenokouji et al. | |
| 6,384,583 | B1 * | 5/2002 | Lestician | 323/276 |
| 6,448,747 | B1 | 9/2002 | Lestician | |
| 2006/0145680 | A1 * | 7/2006 | Shu | 323/355 |

* cited by examiner

*Primary Examiner*—Akm E Ullah
*Assistant Examiner*—Jue Zhang
(74) *Attorney, Agent, or Firm*—Kenneth P. Glynn

(57) ABSTRACT

A system for managing electrical consumption includes a connecting means for connection to an incoming power supply of a facility, for connection in parallel, including a hot line and a neutral line, and at least one ground. The following components are connected between the hot line and the neutral line. They are connected in the order of at least one front capacitor of predetermined capacitance, at least one front arc suppressor, at least one front metal oxide varistor line transient voltage surge suppressor having a predetermined number of joules capability to suppress undesired power spikes, at least two inductor/metal oxide varistor iterative transformers, at least a second capacitor of its own predetermined capacitance, at least one metal oxide varistor having a predetermined number of joules capability and at least two capacitors, each having its own predetermined capacitance different form one another.

19 Claims, 6 Drawing Sheets

THREE PHASE

THREE PHASE

TWO PHASE

ONE PHASE

SYSTEM FOR MANAGING ELECTRICAL CONSUMPTION

REFERENCE TO RELATED APPLICATIONS

The present application is a continuation in part of co-pending provisional application Ser. No. 60/703,441 filed on Jul. 29, 2005 by the present inventor, entitled, "SYSTEM FOR MANAGING ELECTRICAL CONSUMPTION".

BACKGROUND OF INVENTION a. Field of Invention

The present invention relates to electrical power supply, and more particularly to a system for conserving electrical energy consumption in a commercial, industrial, residential, or other energy consumption settings continuing. The present invention conserves electrical energy consumption with control devices at near incoming power breakers to increase efficiency relating to loads, distortions, spikes and/or power factors.

In a typical electrical power consumption setting, electricity is transmitted via power lines or transmission lines to a facility, such as a factory, office, home, etc. The main electrical line is typically connected to a power meter, which in turn is connected to a main breaker box of the facility via a main line. Electricity is distributed to various loads of the facility through various individual circuit breakers in the main breaker box.

Particularly in industrial settings, electrical loads, such as non-linear loads including DC motors, create harmonic distortions, electrical spikes, and poor power factor, which have negative impact on efficiency and the condition of the load itself (e.g., overheating and reduced motor life). Thus, the present invention is a system for managing electrical consumption that includes one or more devices that recognize electromagnetic interference with means to suppress line transient voltage surges, means to regulate harmonics distortion, means to enhance power factor correction and means to maintain phase regulation by maintaining phase relationship between voltage and current at times of increased power demands, using newly discovered arrangements of components to achieve theses results.

b. Description of Related Art

The following patents are representative of systems and devices for conservation of electric consumption:

U.S. Pat. No. 4,163,218 relates to an electronic control system for controlling the operation of a plurality of electrical devices which are energized from AC power lines which includes a single, central unit connected to the power lines, which further includes a central transceiver means for transmitting an encoded oscillating signal of one frequency onto the power lines, a central encoding means for encoding means for encoding the oscillating signal with an encoded signal in synchronization with the frequency of the AC power for selective control of electrical devices, and a central control means connected to the encoding means for selecting the electrical device to be controlled and its desired state. The invention further includes unitary switch units respectively interconnected between power lines and each electrical device being operative for both local and centralized control of the electrical device with the local control and the centralized control placing the electrical device in respective opposite states from each other, each switch unit including a switch transceiver means for receiving the encoded oscillating signal from the power lines, a switch decoding means coupled to the switch transceiver means for detecting the encoded signal, a switch control means connected to the switch decoding means for setting the selected electrical device to the desired state, and a local control means for selectively locally operating the electrical device independently of the central unit and placing the electrical device in a state opposite from that which it was placed by the central unit.

U.S. Pat. No. 4,845,580 describes a spike elimination circuit for A.C. and D.C. power sources which comprises two gas tubes and/or two semiconductor voltage limiting devices before a Bandpass Filter. The Bandpass Filter consists of 2 capacitors to ground and inductor in series with the line. The spike eliminator can be portable, mobile, or hard wired for the protection of home controls and electronics, telecommunications, commercial and industrial controls and the computer field and others.

U.S. Pat. No. 4,870,528 describes a surge suppressor which comprises a first series circuit having a first inductance and a first alternating voltage limiter, including at least a first capacitance and a bidirectionally conductive rectifying circuit for charging the first capacitance, coupled between first and second input terminals for limiting surge currents and voltage excursions coupled to first and second load output terminals. The first alternation voltage limiter further comprises a sensing circuit for sensing at least one of the charging current supplied to the voltage developed across the first capacitance. An auxiliary energy storage circuit and a normally open switching device responsive to the sensing circuit are provided for coupling the auxiliary energy storage circuit across the first capacitance during high energy surge conditions.

U.S. Pat. No. 5,105,327 describes a power conditioner for AC power lines which has a choke and capacitor coupled in series across the power lines. The choke comprises a coil termination in a line, with the line looped back through the coil. The power lines are thereby balanced to provide greater operating efficiency. Capacitors and transient suppressors (e.g. varistors) are used for transient suppression and power factor correction.

U.S. Pat. No. 5,420,741 relates to an arrangement for obtaining flux rate information in a magnetic circuit including passive means connected across a flux rate sensor for implementing control of said flux rate. The passive means being a tuned magnetic flux rate feedback sensing and control arrangement wherein impedance is tuned and the energy loss characteristic is adjustable. The selection of inductance and capacitance values provides tuning and the selection of resistance affects the energy loss characteristics.

U.S. Pat. No. 5,432,710 is directed to an energy supply system for supplying, in system interconnection, power at a power receiving equipment from a power plant and power generated by a fuel cell to a power consuming installation, and supplying heat generated by the fuel cell to a heat consuming installation. This system includes an operation amount computing device for computing an amount of operation of the fuel cell to minimize an equation y-aXL+bXM+cXN, in response to an energy demand of the power consuming installation and heat consuming installation A control device controls the fuel cell to satisfy the amount of the operation computed. The system supplies energy in optimal conditions with respect to the cost borne by an energy consumer, consumption of primary energy and release of environmental pollutants. Energy is effectively used from the standpoint of the energy consumer and a national point of view.

U.S. Pat. No. 5,436,513 relates to an information handling system which is described as having a power supply and having a switching circuit that switches a plurality of energy sources between series and parallel couplings. Associated with the switching circuit is a voltage level detecting circuit for monitoring the voltage level of the energy sources. A processor for controlling the information handling system responds to the voltage level detecting circuit and in the event of a low voltage condition the processor activates the switching circuit to switch the energy sources and from a series to a parallel coupling. Alternatively, the processor responds to other inputs or conditions for actuating the switching circuit.

U.S. Pat. No. 5,459,459 is directed to an algorithm for implementation in a meter register and a reading device. In the one embodiment, the invention enables selecting a display table to be read from the register, updating the billing read date and time in the register, reversing the order in which load profile data is transmitted from the register to the reader, specifying the number of load profile intervals to be read from the register and specifying the number of intervals to skip when reading from the register.

U.S. Pat. No. 5,462,225 relates to an apparatus and method for controlling energy supplied to a space conditioning load and for overriding a load control operation in response to measuring certain space temperatures within a closed environment. The load control apparatus includes a control device connected to an electrical distribution network and to a space/conditioning load and a temperature sensing device connected to the control device. The control device conducts a load shedding operation to control distribution of electrical energy to the space conditioning load in response to command signals supplied by a remote command center. The temperature sensing device operates to override the load shedding operation by outputting a control overriding signal to the control device tin response to sensing certain space temperatures within the closed environment. If the temperature control device is connected to an air conditioning system the temperature sensing device causes the control device to terminate the load shedding operation prior to expiration of a selected time period in response to measuring a space temperature that exceeds a maximum space temperature limit. In contrast, if the temperature control device is connected to a forced air beating system, the temperature sensing device causes the control device to terminate the load shedding operation when a measured space temperature drops below a minimum space temperature limit the maximum space temperature limit is greater than the control temperature setpoint of a thermostat that controls the space conditioning operations, whereas the minimum space temperature limit is less than the control temperature setpoint.

U.S. Pat. No. 5,483,672 relates to a communication system, where a communication unit may conserve source energy when it is inactive in the following manner. The control channel is partitioned into a predetermined number of windows and a system window which are transmitted on the control channel in a round robin manner. When the communication unit registers with the communication system, it is assigned to a window group. The communication unit then monitors only the system window to determine whether the window group that its been assigned to is also assigned to one of the predetermined number of windows. When the window that has been assigned to the window group is being transmitted to the control channel the communication unit activates to monitor that window. Once the window is no longer being transmitted, the communication unit deactivates unit the system window is being transmitted or the window assigned to the window group is being transmitted.

U.S. Pat. No. 5,495,129 relates to an electronic device fore multiplexing several loads to the terminals of a source of alternating electrical energy. The source of alternating electrical energy is coupled by electromagnetic flux to the loads by using primary excitation windings and connects to the terminals of the source of alternating electrical energy and secondary windings respectively corresponding to the number of loads. The secondary windings are at least partially coupled to the primary winding and are each connected to the terminals of a load. The coupling is inhibited by auxiliary winding which are each totally coupled with the secondary winding. The inhibition function is controlled in order to inhibit all the magnetic couplings except for one and this particular one changes as a function of the respective loads to be coupled to the source of alternating electrical energy.

U.S. Pat. No. 5,512,831 relates to a system for testing electrochemical energy conversion and storage devices includes means for sensing the current from the storage device and varying the load across the storage device in response to the current sensed. The system is equally adaptable to batteries and fuel cells. Means is also provided to sense system. Certain parameters are then stored in digital form for archive purposes and certain other parameters are used to develop control signals in a host processor.

U.S. Pat. No. 5,517,188 is directed to a programmable identification apparatus, and associated method, includes a transceiver and a transponder. The transponder is powered by the energy of a transceiver transmit signal generated by the transceiver and includes a programmable memory element. A coded sequence which uniquely identifies the transponder is stored in the programmable memory element and, when transponder is powered, the transponder generates a transponder signal which includes the coded sequence stored in the programmable memory element, once modulated by circuitry of the transponder.

U.S. Pat. No. 5,528,123 measures the total line current in a power cord which is used to energize both a power factor corrected system and a non-power factor corrected AC loads. The power factor control loop of the power factor corrected system is then driven to correct the power factor of total line current in the power cord ideally to approach unity.

U.S. Pat. No. 5,640,314 relates to a symmetrical ac power system which provides a balanced ac output, whose maximum voltage with respect to a reference ground potential is one-half the ac output voltage, and which is derived from a single phase ac source through the use of an isolation transformer having a center-tapped secondary winding. The center tap is connected to the output power load circuit as a ground reference potential with respect to the symmetrical ac output so as to constitute the reference ground potential for the power supply and load. Since symmetrical ac power is applied to the load by the system, reactive load currents, other power artifacts, EMI and RFI emissions and other interference and noise components ordinarily resulting from the application of conventional ac power to the load are reduced or eliminated by appearing as equal inversely phased signal elements which cancel one another. In order to maximize the performance of the symmetrical power system, the isolation transformer has a bifilar-wound secondary winding.

U.S. Pat. No. 5,646,458 describes a UPS (uninterruptible power system) which includes an UPS power conditioning unit that provides conditioned AC power to a critical load. The UPS power conditioning unit includes a variable speed drive that operates in response to AC utility power or to a standby DC input by providing a motor drive signal. The UPS power conditioning unit further includes a motor-generator that operates in response to the motor drive output by providing the conditioned AC power to the critical load. In response to an outage in the utility AC power, standby DC power is provided by a standby DC power source that includes a variable speed drive and a flywheel motor-generator connected to the variable speed drive. Both the UPS power conditioning unit and the standby DC power source are initially operated in response to the utility AC power, the flywheel motor-generator storing kinetic energy in a rotating flywheel. When an outage occurs, the rotating flywheel continues to operate the flywheel motor-generator of the standby DC power source, causing the production of AC power which is rectified and provided as standby DC power to operate the variable speed drive of the UPS power conditioning unit either the utility AC power outage is over or a standby emergency generator is brought on line.

U.S. Pat. No. 5,880,677 relates to a system that monitors and controls electrical power consumption that will be retrofitted to a typical consumer electrical power arrangement (typical arrangement-electrical feed line from a provider, a meter, a circuit breaker and individual input wiring to a plurality of electrical devices, appliances and outlets). The system includes a control unit which receives information from an electromagnetic pickup device from which real time electrical consumption is determined over very short periods of time. The control unit has a main data processing and storage processor for retaining information and it may include a communication microprocessor for sending signals to corresponding modules. The electromagnetic pickup device uniquely measures the electromagnetic flux emanating at each output wire from each of the individual circuit breakers in a breaker box. The modules have filters which release electrical power to the individual electrical devices, appliances and outlets at a controlled, economic rate.

U.S. Pat. No. 5,892,667 describes a symmetrical as power system which provides a balanced ac output, whose maximum voltage with respect to a reference ground potential is one-half the ac output voltage, and which is derived form a single phase ac source through the use of an isolation transformer having a center-tapped secondary winding. The center tapped is connected to the output power load circuit as a ground reference potential with respect to the symmetrical ac output so as to constitute the reference ground potential for the power supply and load. Since symmetrical ac power is applied to the load by the system, reactive load currents, other power artifacts, EMI and RFI emissions and other interference ad noise components ordinarily resulting from the application of conventional ac power to the load are reduced or eliminated by appearing as equal inversely phased signal elements which cancel one another. In order to maximize the performance of the symmetrical power system, the isolation transformer has a bifilar-wound secondary winding.

U.S. Pat. No. 6,009,004 discloses a new single-phase passive harmonic filter for one or more nonlinear loads. The filter improves the total system performance by drastically reducing the line side current harmonics generated by non-linear loads. The filter includes two inductive portions across one of which is connected a tuning capacitor. The parallel combination of one inductive portion which the tuning capacitor forms a series tuned filter configuration while the second inductive portion is used for harmonic attenuation. A shunt capacitor is employed for shunting higher order harmonic components. A single-phase passive voltage regulator provides the needed voltage bucking to prevent over voltage at the load terminals of the filter. The filter provides an alternate path for the harmonic current generated by non-linear loads. The over voltage caused by the increased capacitive reactance is controlled by either capacitor switching or by the use of the passive voltage regulator or a combination of the two. Capacitor switching is dependent upon load conditions.

U.S. Pat. No. 6,014,017 describes a method and an apparatus for power factor correction for a non-ideal load, which is supplied for a main power supply, by a compensation device which is electrically connected in parallel with the load and has a pulse converter with at least one capacitive store. A transfer function space vector is calculated as a function of a determined mains power supply voltage space vector, a mains power supply current space vector, a compensator current space vector and of an intermediate circuit voltage which is present on the capacitive store. As a result of which the pulse converter generates a compensator voltage space vector on the main power supply side as a function of the intermediate circuit voltage. A compensator current space vector, that keeps the undesirable reactive current elements away from the mains power supply, is thus obtained via a coupling filter that is represented as a compensator inductance.

U.S. Pat. No. 6,058,035 describes a method wherein after starting the input of a switching signal to a booster circuit whose boosting rate is changeable in accordance with the duty ratio of the inputted switching signal and calculating the output power of an inventor circuit, which is connected to the subsequent stage of the booster circuit, from the output current of the inverter circuit, the target voltage after boosting by the booster circuit is obtained based on the output power. If the actual output voltage of the booster circuit is lower then the target voltage, the duty ratio of the above switching signal is increased, and if higher, the duty ratio of the above switching signal is decreased.

U.S. Pat. No. 6,384,583 B1 is a system including, in-parallel connection to an incoming power supply of a facility including a hot line and a neutral line, and at least one ground. There are components connected between the hot line and the neutral line in the order of: front metal oxide varistors; line transient voltage surge suppressor having to suppress undesired power spikes; at least one capacitor of predetermined capacitance; at least two dual chokes in the form of inductor/metal oxide varistor transformers; at least a second capacitor of its own predetermined capacitance; metal oxide varistors having a predetermined capability. In preferred embodiments, the metal oxide varistor may be a plurality of varistors in parallel; a failure indicator circuit connected to the transient voltage surge suppressor, including at least one relay, one voltage-surge responsive switch and one indicator signaling component.

U.S. Pat. No. 6,384,583 B1 is an electricity pod controller device that includes in-parallel connection to an incoming power supply of a facility including a hot line and a neutral line, and at least one round. There are components connected between the hot line and the neutral line. At least one front metal oxide varistor line transient voltage surge suppressor has a predetermined capability to suppress undesired power spikes and at least one capacitor of predetermined capacitance are also included. At least two dual chokes in the form of inductor/metal oxide varistor transformers, a second capacitor of its own predetermined capacitance and at least one metal oxide varistor having a predetermined capability. In preferred embodiments, the metal oxide varistor may be a plurality of varistors in parallel.

Notwithstanding the prior art, the present invention is neither taught nor rendered obvious thereby.

SUMMARY OF INVENTION

The present invention solves the problems and overcomes the drawbacks and deficiencies of prior art surge suppressors and voltage regulators that failed to address different types of phase angle and harmonics problems, and do not adequately respond to simultaneous or near simultaneous multiple power difficulties.

The present invention, a system for managing electrical consumption, includes a connecting means for connection to an incoming power supply of a facility, for connection in parallel, including a hot line and a neutral line, and at least one ground. The following components are connected between the hot line and the neutral line. They are connected in the order of at least one front capacitor of predetermined capacitance, at least one front arc suppressor, at least one front metal oxide varistor line transient voltage surge suppressor having a predetermined number of joules capability to suppress undesired power spikes, at least two inductor/metal oxide varistor iterative transformers, at least a second capacitor of its own predetermined capacitance, at least one metal oxide varistor having a predetermined number of joules capability and at least two capacitors, each having its own predetermined capacitance different form one another.

The present invention system for managing electrical consumption includes a device that may have a plurality of front metal oxide varistors in parallel. In some preferred embodiments, it may have a plurality of capacitors having different capacitances at its back end.

The components may be arranged for operating as a single phase device. At the components may be duplicated to create two connected sets that are arranged for operation as a two phase device that may also include at least one resistor having a predetermined resistance. The components may be triplicated to form three connected sets that are arranged as a three phase device that includes at least one resistor having a predetermined resistance.

In other preferred embodiments, the present invention is a dual iterative transformer that includes a first circular magnetic coil core, a second circular magnetic coil core, a first incoming wire, and a second incoming wire. The first incoming wire is being wrapped in a first plurality of windings around approximately half of the first circular magnetic coil core and then traversing a predetermined distance between the second circular magnetic coil core and then is wrapped in a second plurality of windings around approximately half of the second circular magnetic coil core and continuing away from the second circular magnetic coil core. The second incoming wire is positioned along one half of the external periphery of the first circular magnetic coil core and under the first plurality of windings of the first incoming wire. It then passing linearly to the second circular magnetic coil core and then is wrapped in a first plurality of windings around approximately half of the second circular magnetic coil core away from and opposite the first incoming wire second plurality of windings, and then linearly returning to the first circular magnetic coil core. It is then wrapped in a second plurality of windings around approximately half of the first circular magnetic coil core away from and opposite the first plurality of windings of the first incoming wire. Then it is wrapped in a third plurality of windings around the first incoming wire away form and between the first circular magnetic coil core and the second circular magnetic coil core. It is then positioned along one half of the external periphery of the second circular magnetic coil core under the first incoming wire second plurality of windings. By "iterative transformer" is meant a transformer that acts as a dual choke or clamp and is capable of simultaneous multiple power difficulties by iteratively making corrections and then correcting the corrections that have been affected by other difficulties. In other words, the arrangement of the component in the present invention system, device and transformers include means and capabilities for correcting intrusive errors to corrections. Additionally, the present invention systems, devices, and iterative transformers function not only at standard 60 hertz cycles but will function very well within a broad range of different cycles including 30 hertz to 100 hertz.

In some preferred embodiments, the dual iterative transformer in the first circular magnetic coil core and the second circular magnetic coil core are toroids of equal size. The second incoming wire, after its first plurality of windings and before its second plurality of windings, is semi-circularly positioned atop the first plurality of windings of the first incoming wire first plurality of windings.

In some preferred embodiments, the dual iterative transformer of the first incoming wire is a black or colored wire having an inductance within the range of 1.0 to 1.15 millihenries, plus or minus five percent and the second incoming wire is a white wire having an inductance of about 1.05 millihenries, plus or minus ten percent. The first incoming wire and the second incoming wire may be 10 to 6 gauge wires in some preferred embodiments.

In some preferred embodiments, the present invention system for managing electrical consumption includes at least two inductor/metal oxide varistor iterative transformers, each having a first circular magnetic coil core, a second circular magnetic coil core, a first incoming wire and a second incoming wire. The first incoming wire is wrapped in a first plurality of windings around approximately half of the first circular magnetic coil core and then traversing a predetermined distance between and to the second circular magnetic coil core and then being wrapped in a second plurality of windings around approximately half of the second circular magnetic coil core and continuing away from the second circular magnetic coil core. The second incoming wire is positioned along one half of the external periphery of the first circular magnetic coil core and under the first plurality of windings of the first incoming wire. It then passing linearly to the second circular magnetic coil core and then is wrapped in a first plurality of windings around approximately half of the second circular magnetic coil core away from and opposite the first incoming wire second plurality of winding. It then linearly returning to the first circular magnetic coil core and is wrapped in a second plurality of windings around approximately half of the first circular magnetic coil core away from and opposite the first plurality of windings of the first incoming wire, and then being wrapped in a third plurality of windings around the first incoming wire away form and between the first circular magnetic coil core and the second circular magnetic coil core. Then it is positioned along one half of the external periphery of the second circular magnetic coil core under the first incoming wire second plurality of windings.

In some preferred embodiments, the present invention is a device for multiple dual iterative transformers, which includes a main housing having a plurality of bins, each of the plurality of bins having a dual iterative transformer including a first circular magnetic coil core, a second circular magnetic coil core, a first incoming and a second incoming wire. The first incoming wire is wrapped in a first plurality of windings around approximately half of the first circular magnetic coil core and then traversing a predetermined distance between and to the second circular magnetic coil core and then is wrapped in a second plurality of windings around approximately half of the second circular magnetic coil core and continuing away from the second circular magnetic coil core. The second incoming wire is positioned along one half of the external periphery of the first circular magnetic coil core and under the first plurality of windings of the first incoming wire, and then passing linearly to the second circular magnetic coil core and then being wrapped in a first plurality of windings around approximately half of the second circular magnetic coil core away from and opposite the first incoming wire second plurality of windings, and then linearly returning to the first circular magnetic coil core and being wrapped in a second plurality of windings around approximately half of the first circular magnetic coil core away from and opposite the first plurality of windings of the first incoming wire, and then being wrapped in a third plurality of windings around the first incoming wire away form and between the first circular magnetic coil core and the second circular magnetic coil core, and then being positioned along one half of the external periphery of the second circular magnetic coil core under the first incoming wire second plurality of windings.

The plurality of bins may have divider walls between each of the dual iterative transformers that include a conductive metal plate having opposite sides covered with a non-conductive material. The divider walls may include grounded aluminum plates. The non-conductive materials may be composite deck boards. The divider walls may include a grounded aluminum plate sandwiched between insulative composite deck boards wherein each insulative composite deck board is about $1/16^{th}$ to $3/16^{th}$ inches thick.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Overview

In one preferred embodiment, the present invention is a system that is in line with AC Incoming Voltage to an electrical load site, such as an industrial/commercial educational or recreational facility. A typical electrical supply arrangement includes an electrical feed line from the service provider connected to all of the electrical devices in a particular location, as in the case of circuit breakers for the main source or Fuel Cell and generator for large motors.

In one implementation, the system is attached at the main source for such things as large motors and motor driven systems. It is connected in a manner that reduces the harmonics in a building; lowering the total harmonic distortion (ThD) to a very low value and adjusting any low Power Factor to be adjusted to 0.95 or greater. Included is a Transient Voltage Surge Suppressor (TVSS) with a feature to reduce the spikes that can be portable, mobile, or hard wired for the protection of the location.

With this in mind, the system can reduce the demand for power by controlling the noise factor and regulating surges/sags in a building, thereby lowering the energy consumption. The system also has the ability to work with large generators and with fuel cell systems for preventing a loss of voltage and current in a given situation and maintaining power requirements needed for short periods of time. In the generator, the system not only reduces kilowatt usage being drawn but also reduces its need for fuel consumption. In the Fuel Cell, the system is able to suppress the surge/sag, which results in more efficiency for the Fuel Cell to produce more energy.

In one implementation, a parallel AC power system helps provide a balanced AC load to the potential electrical feed to the building or power supplied by the utility company by means of an electrical enclosure with its electrical parts. It is installed parallel to the main load and/or to the motors drawing the most power. It acts as a voltage and current absorber and corrects a poor power factor. It also improves the THD (Total Harmonic Distortion).

When this device is connected in parallel to the source, it decreases the phase angle of current and voltage. If voltage or current are out of phase it adjusts to proper phase. This system reduces power consumption and responds to the load by means of its current draw and adjusts to the demand by lowering its storage mechanisms. It adjusts the voltage to its current demands by giving the device a supply of voltage, which results in lower demand on usage of its power consumption.

Principles of the present application are particularly applicable to industrial settings with high current demands (e.g., with loads drawing up to 2500 Amps). It should be recognized, however, that principles of the present invention are applicable to other electrical load settings.

EXAMPLES

Figure 1:
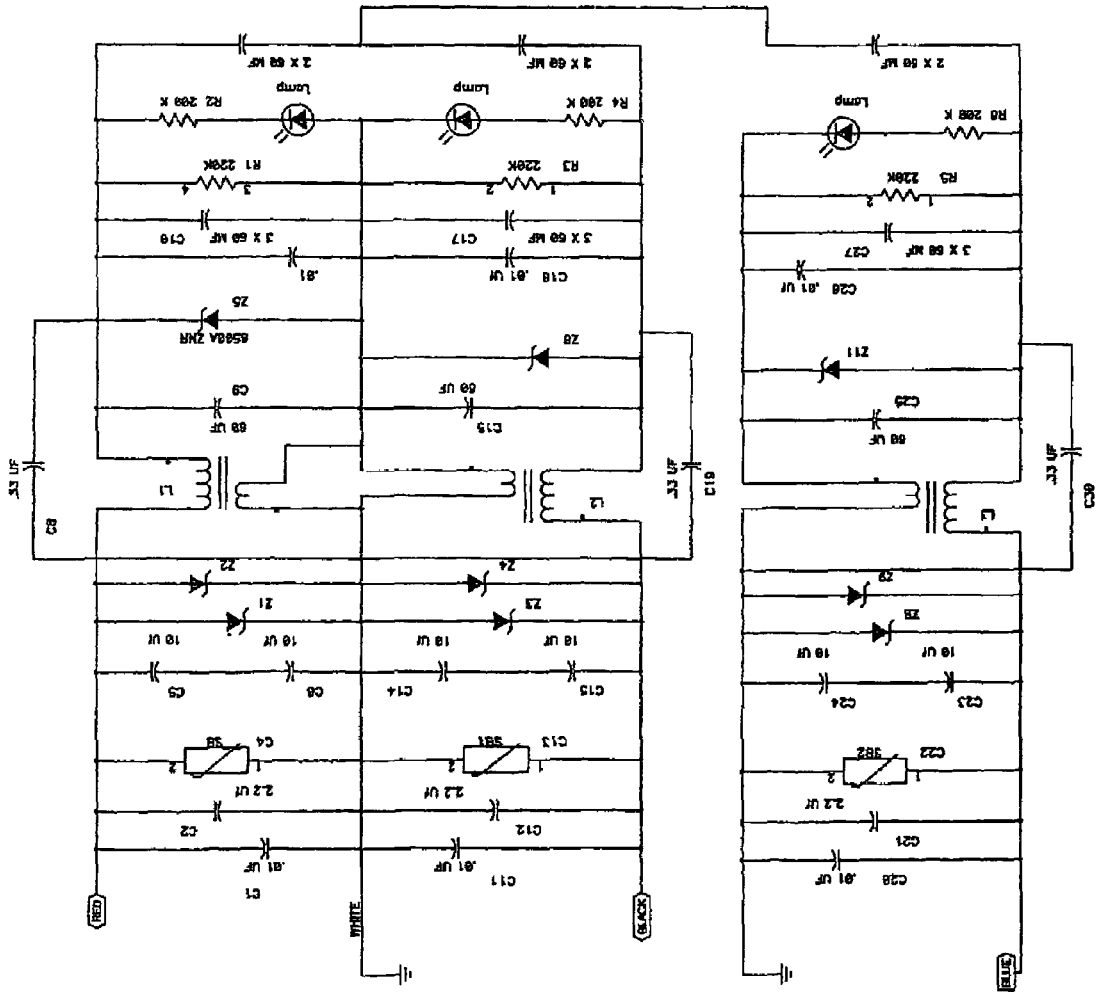
FIG. 1 illustrates a schematic diagram of a system for managing electrical consumption in accordance with an embodiment of the present invention; for a three phase power unit.

FIG. 1 is a schematic diagram illustrating an electrical power conditioning system in accordance with an embodiment of the present invention. The schematic diagram of FIG. 1 is a three phase arrangement, although it should be recognized that the principles embodied in the arrangement illustrated in FIG. 1 are applicable to a single phase arrangement, a two phase arrangement, etc. In FIG. 1, the "White" line is a neutral line, and the "Red," "Blue," and "Black" are so-called "hot lines" or "hot legs." Although FIG. 1 includes specific values for circuit elements illustrated therein, in should be realized that these are exemplary values and that these values may vary depending on the particular electrical power distribution environment.

Generally, the arrangement of FIG. 1 employs a generating means connected in a paralleling noise reduction unit to the incoming power source from Red, Blue and Black lines. Capacitors C1, C2, C11, C12, C20, C21 (which are a dry film type according to one preferred present invention embodiment implementation) are connected in parallel to the front end of the unit. This helps in the reduction of the lower harmonic noise on the fundamental frequency (e.g., 50 Hz/60 Hz) input lines. This type of arcing band pass filter, (Electrolytic filter capacitors are intolerant of reverse current and heat. Electrolytic capacitor working voltage [WV] ratings should be treated with respect. The WV rating is virtually the maximum voltage rating. Despite their more delicate nature, electrolytic filter capacitors offer substantial advantages over oil-filled filter capacitors. The main advantages are more joules of energy storage per dollar, reduced weight and reduced volume. This combination with the dry caps is called an "Arcing Setup" in a circuit with the installed MOVs. When electrolytic capacitors are operated in series, they should share the voltage equally. In order to do this, a voltage equalizer resistor is connected across each capacitor. The equalizer resistor comes with the caps on them) working with capacitors C5, C6, C14, C15 (which are oil type capacitors for high current use according to an embodiment of the present invention) function to remove the lower fundamental frequencies of the harmonic bands with a filter for high frequency spikes, sparking and transients with a snubber network, C4, C13, C22 (which are Quencharc type according to an embodiment of the present invention), in the circuit helping to reduce noise created by motors running on that panel box.

Capacitors C5, C23, C6, C24 (which are oil type capacitors for high current applications according to an embodiment of the present invention) are connected in series to allow for more current to pass; in addition the needed values will be half the capacitance but will allow for more current to pass through them and prevent damage to the capacitors in this manner from the harmonic noise still passing through them. The MOVs (metal oxide varistors) Z1, Z2, Z3, Z4, Z8, Z9 are for the transients spikes from the input line and also reduce the transponder non-fundamental frequencies for the AC line suppression for creating a very clean EMI/RFI reduction from the power lines.

Arranging dual chokes L1, L2, L3 in series on the Hot legs (Red, Blue and Black) creates a low pass filter or other non-fundamental frequency currents flowing to the load but opposite in phase; filter for as setting up a current load to the source for balancing of the phases being applied to capacitors C9, C15, C25 (which are oil type capacitors according to an embodiment of the present invention). This large LC type network creates a network where the current being drawn by the incoming load reacts with the power factor; this will create an imbalance load in the case of off set lagging current and creating a current generating means in which the excess power is then converted to power from the fundamental frequency then supplied back to the AC power source, which may include a generator or fuel cell.

With MOVs Z5, Z6, Z11 across the leading current, the MOV's now can reduce the major part of the voltage transients whereas the current now will be reduced at the source. Capacitors C10, C17, C27 (which are oil type capacitors for high current according to an embodiment of the present invention) are provided in the circuit for added protection of the stray harmonics that could damage the upcoming capacitance stage, whereas this will keep the capacitors from having more current through them to prevent an unwanted catastrophic failure. The output stage with the (2×60 MF) capacitors are acting as a Voltage/Current storage device; wired as a "Y" or delta configuration sets up a Kvar injection to the incoming source for proper balancing of all voltage and current fields across the current power source. The resistors R2, R4, R6 in conjunction with a lamp, displays an indication for that phase which is active.

Paralleling up to 12 of these device stages together across the 3 phases and injection of 1000 to 50000 Kvar's to the power source with great response with less noise created by the motors and the inductive loads; this nonlinear loading represented by non-fundamental frequency load currents in the source; the demand with harmonics on a given location creating a larger bill to the customer and not really using that demand. This will bring the demand down on a building with the reduction of harmonics, thereby stabilizing the building with cleaner AC power in the building.

The first stage of the system illustrated in FIG. 1 functions as an EMI/TVSS section for all suppressors needed for incoming voltage spikes. This band pass filter reacts to the line load by injection of Kvar's to the source. The second stage of the system illustrated in FIG. 1 acts as a variable inductor filter to handle the THD and the power factor of the line loads. The last stage of the system illustrated in FIG. 1 creates storage capacity to keep the unit under load with a voltage/current reserve for unexpected surges and sags.

Significantly, this system lowers the harmonics being produced by the motor (in the case in which the load is a motor), thereby greatly reducing the current being consumed. As an additional benefit, this keeps the motor running cooler, hence reducing the wear and tear on the motor. Furthermore, there is achieved a reduction of energy being used by means of Kw (kilowatt hours) through lowering the demand from its source. Energy savings will occur with all of these key features working together; the result being a significant (e.g., 15 to 30%) reduction of energy used by the consumer and less maintenance on motors with a cleaner energy going back to the utility company supplying the power.

Dual Choke Design

According to an embodiment of the present invention, dual chokes L1, L2, and L3 are configured using a coil design as described herein below. Generally, a coil design according to this embodiment of the present invention employs a generating means of detecting the current in the paralleling noise reduction unit to the incoming power source. In one implementation, each coil is situated in an upright position and is constructed with the following components for its makeup: two toroids are Part number TX87/54/14-3C90 materials; wire is being used is a "THWN" gas and oil type and wire gauge is from 10 gauge to 6 gauge.

The direction of the wire from the white (Neutral) is wound in a proper manner for the magnet flux fields and have this conformingly to the windings. The Hot legs using a color such as (Black, Red, Blue) also follow this winding pattern for proper operation. This has the most effect on the loads being applied to for the direction of the currents being picked up from the source. The reaction of the white (Neutral) plays a roll in where this reduces the amount of frequencies where as it puts the phasing at 180 degrees out of phase to the incoming hot leg. The means of winding the hot also places a 90 degree phase from the white, and thus counter reacts the flow of current and the harmonic frequencies out of phase to the coil reactor in the circuit. This sets up the current sensing device for the voltage and the current sensing whereas it removes the fundamental frequency component acting in a manner as a notch filter device to the applied circuit; its power efficiently flows in either direction between its output storage capacitors in the circuit. Like a notch filter, this removes the fundamental frequencies and controls the current source by injecting a current back into the AC power line from the storage capacitors connected in a manner like a "Y" or Delta stage in the unit. This method can be called as a reactor or a means of controlling the harmonics in a given power source for means of saving energy and the reduction of harmonics that reduces the capacitors life a great deal in a circuit. This also can be used as a current detection method in which it can replace a "CT" clamp used to detect the current in a given circuit with out clamping it to the incoming line.

Figure 2:
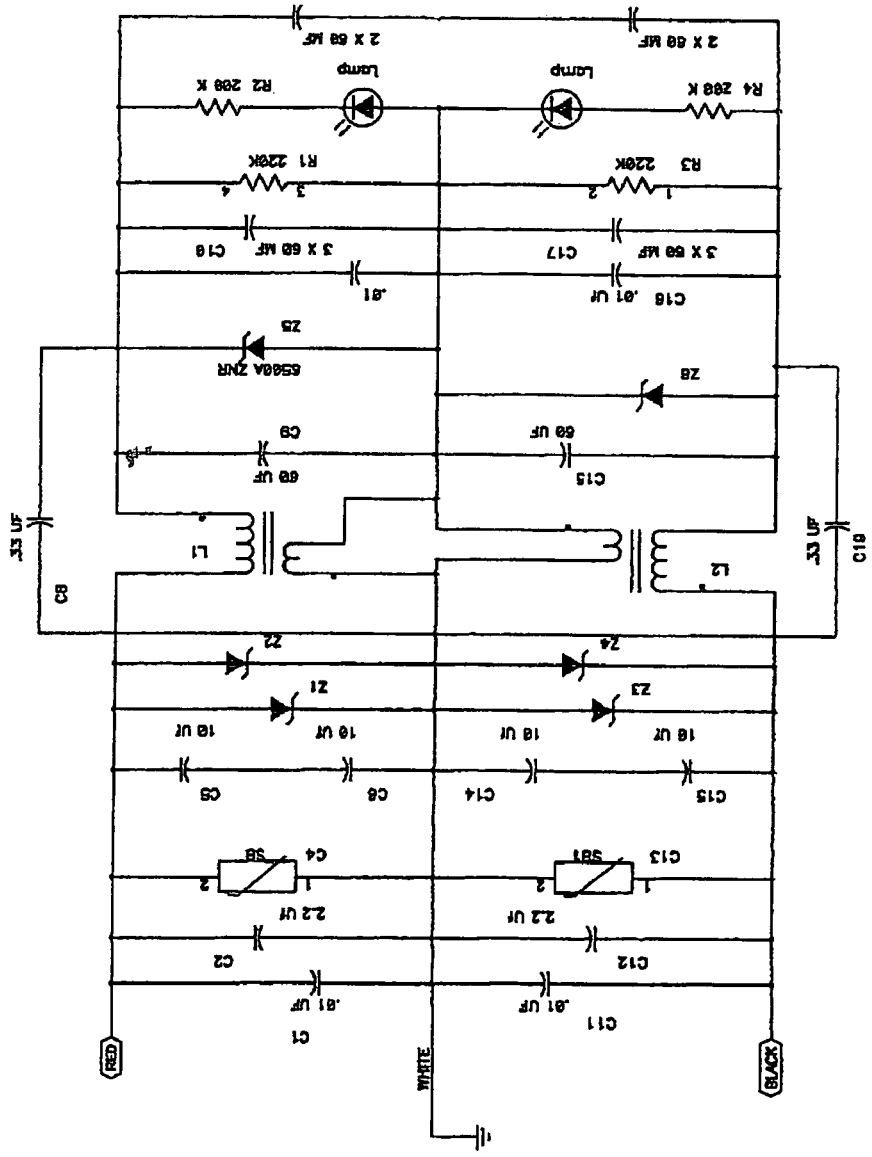
FIG. 2 illustrates a schematic diagram of a system for managing electrical consumption in accordance with an embodiment of the present invention; for a two phase power unit.

FIG. 2 shows a preferred present invention System for managing electrical consumption for a two phase unit. Thus, ⅔ of the components and arrangements are identical to the arrangements and values set forth in the top ⅔ of Figure one described above this all of the components and related values shown in FIG. 1 that pertain to the FIG. 2 components are identical and need not be repeated.

Figure 3:
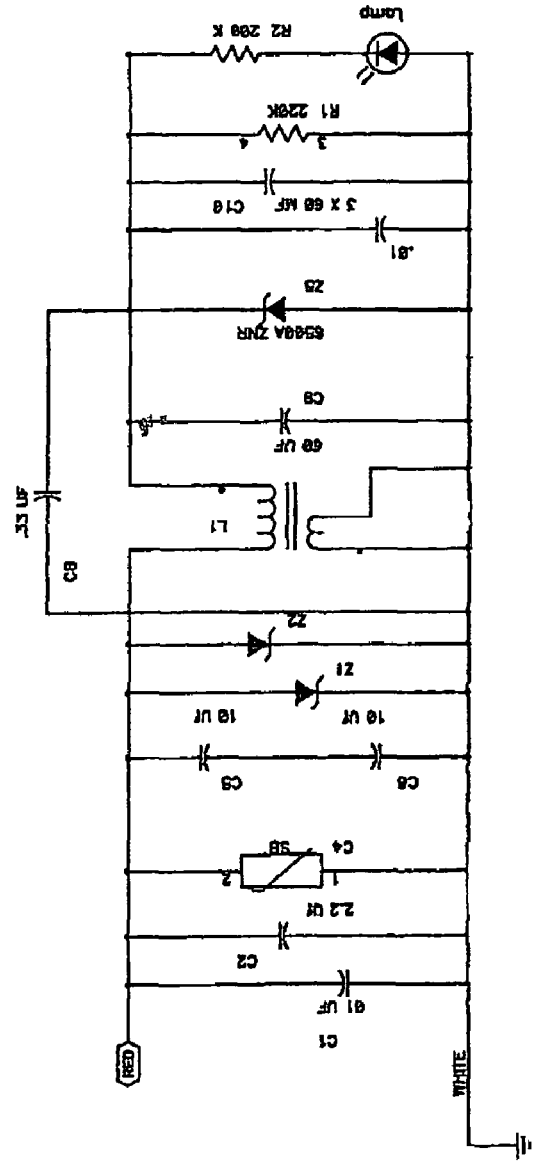
FIG. 3 illustrates a schematic diagram of a system for managing electrical consumption in accordance with an embodiment of the present invention; for a one phase power unit.

FIG. 3 shows a preferred present invention System for managing electrical consumption for a one phase unit. Thus, ⅔ of the components and arrangements are identical to the arrangements and values set forth in the top ⅔ of Figure one described above this all of the components and related values shown in FIG. 1 that pertain to the FIG. 2 components are identical and need not be repeated.

Figure 4:
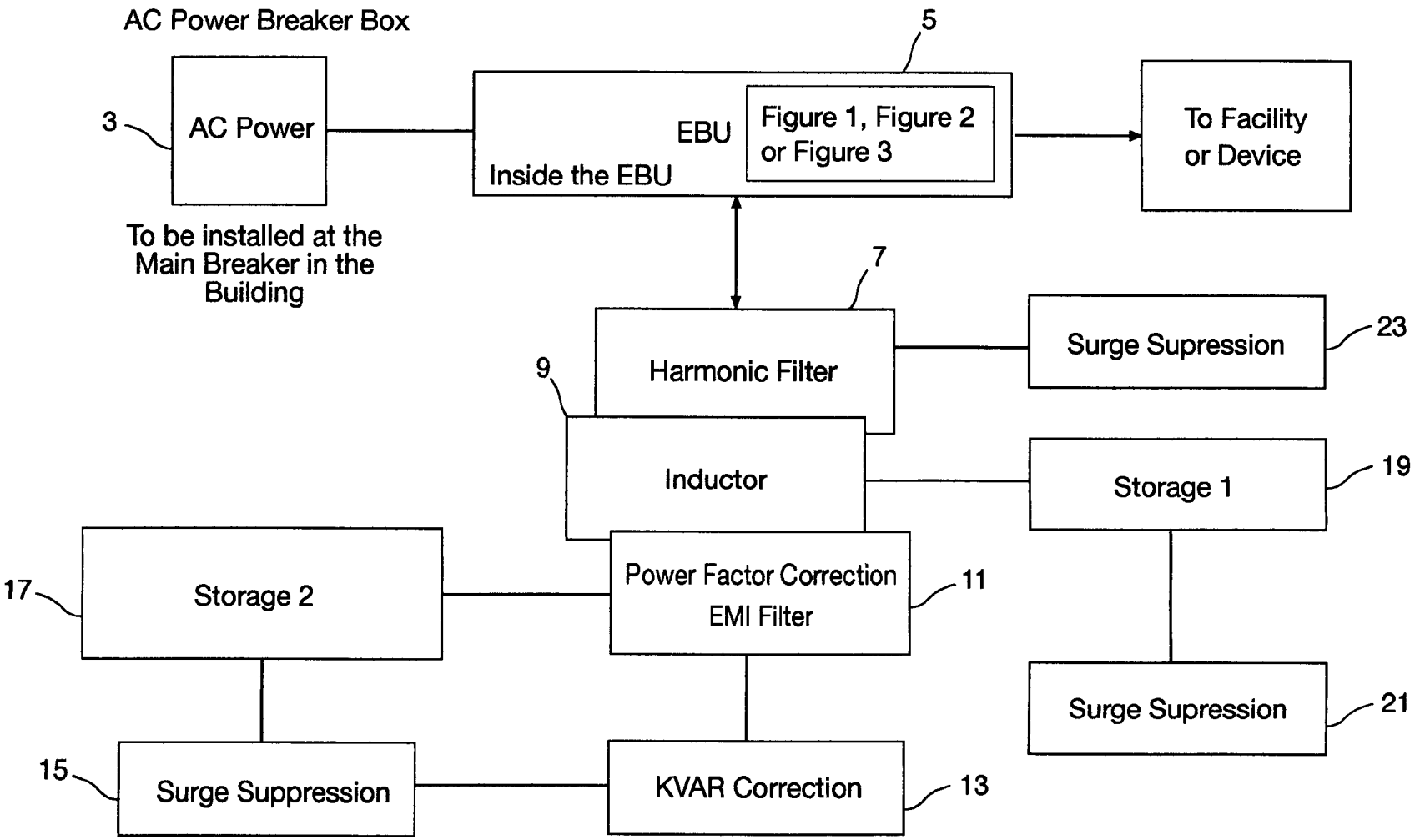
FIG. 4 shows a schematic diagram illustrating features of some preferred embodiment present invention system for managing electrical consumption.

FIG. 4 shows a schematic diagram that illustrates the preferred embodiment of present invention system showing the essential electronic features. AC power 3 comes into a facility with a main breaker box and is then fed through an appropriate present invention System for managing electrical consumption. By appropriate, it is meant the correct size and model for a one phase, two phase, or three phase service. Energy bank unit 5, thus, may be any of the configurations described above with respect to the present invention system. FIG. 4 now illustrates, with boxes and connecting lines, the various electronic functions and relationships described above. They include harmonic filter 7 with surge suppression 23, inductor 9 with first power storage 19 and surge suppression 21. Power factor correction 11 includes an EMI filter and is connected to both second power storage 17 and KVR correction 13. Surge suppression 15 is connected to both the second power storage 17 and KVR correction 13.

Figure 5A:
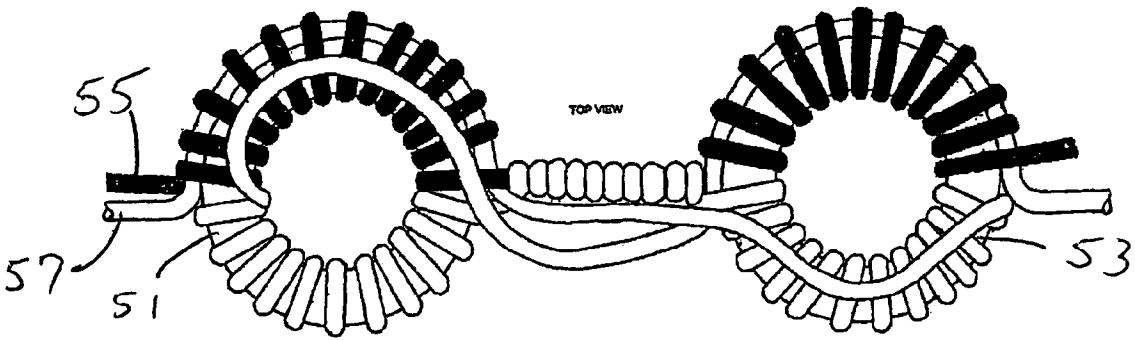
FIG. 5A is a top view of a coil device according to an embodiment of the present invention.
Figure 5B:
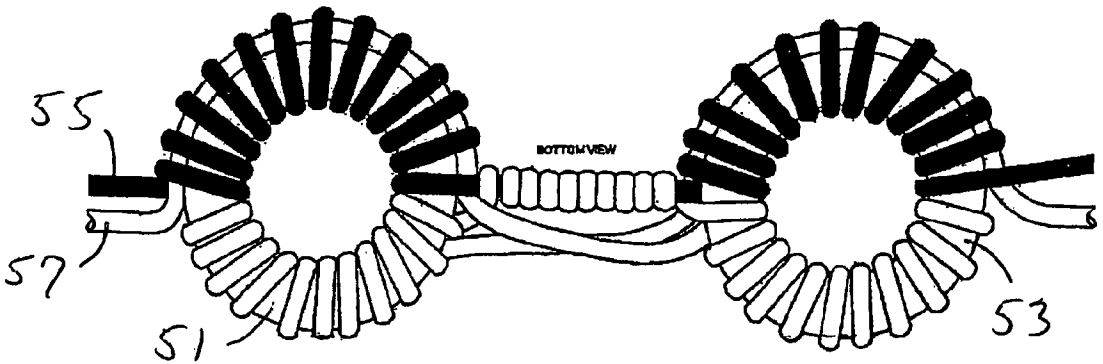
FIG. 5B is a bottom view of a coil device according to an embodiment of the present invention.

FIG. 5A is a top view of a coil design according to an embodiment of the present invention. FIG. 5B is a bottom view of a coil design according to an embodiment of the present invention. Magnetic coil core 51 and 53 are the foundation of the double choke arrangements that form the iterative transformers utilized in the present invention system. These magnetic coil cores are circular in the figure but could be rectangular or otherwise shaped. There's a first incoming wire 55 and a second incoming wire 57. In these Figures, it is apparent how the wires are placed on the coils and the reverse direction of how it wired up on the toroids. The Values on the White are 1.05 millihenries plus or minus ten percent. The Values on the Black or (COLOR) are 1.15 millihenries plus or minus ten percent.

Figure 6:
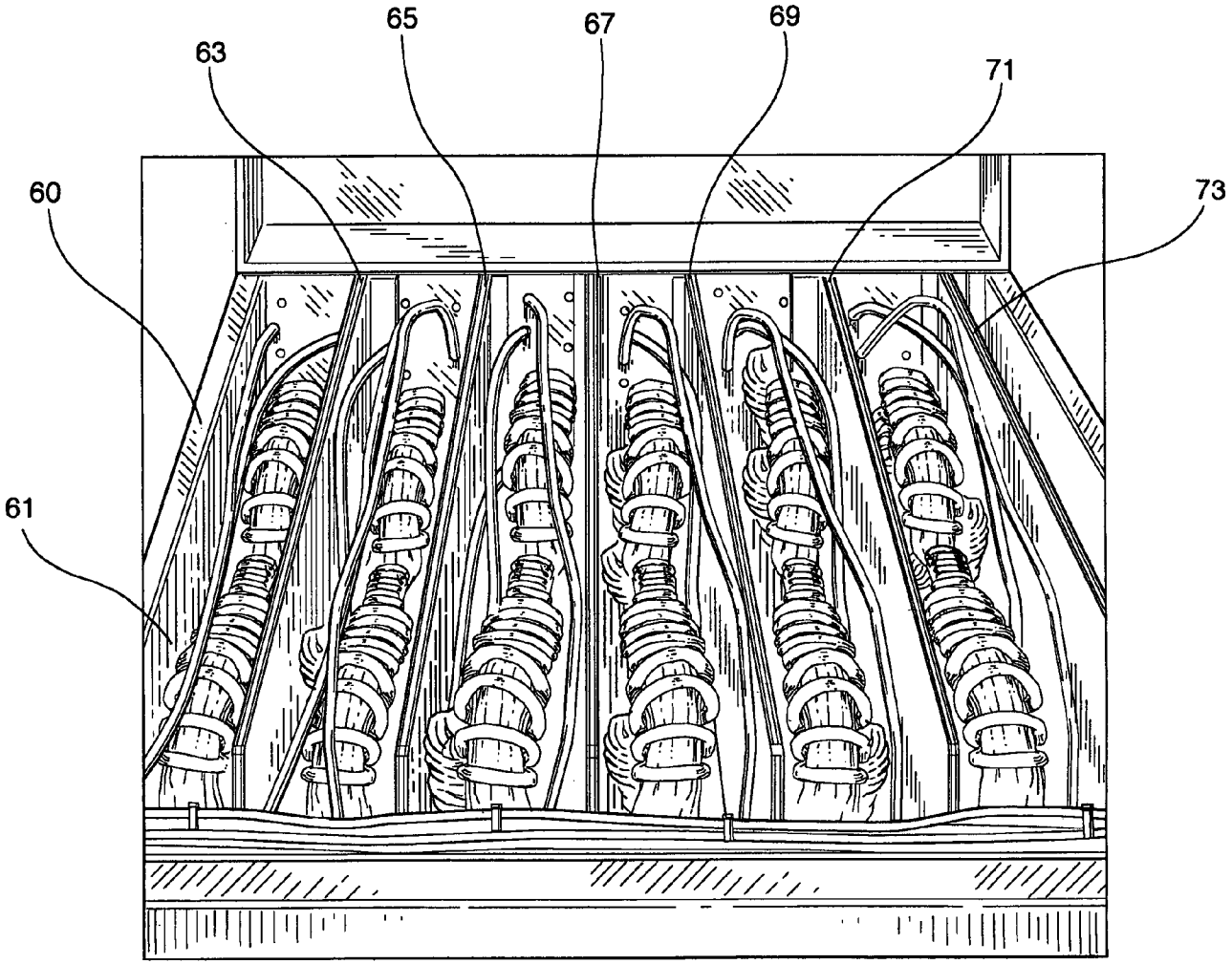
FIG. 6 shows a top view of a plurality of present invention iterative transformers arranged in a present invention main housing.

In one implementation of the present invention, these units are mounted in a main housing with dividers made of fiberglass/aluminum/fiberglass used to separate the coils from each other. FIG. 6 shows the main housing 60 with dividers 61, 63, 65, 67, 69, 71, and 73 for mounting six of the coil devices. Subsequently, they are potted with Epoxie to seal up the units. As shown in FIG. 6, a box containing the coil devices as described above are combined with other elements of the system described herein to form a "complete unit." As described above, depending on the application, multiple units of any number can be combined in parallel.

Relevant/Related Concepts

The following discussion is provided to further elaborate on concepts relevant to aspects of the present invention.

Positive sequence harmonics—such harmonics try to make a motor run faster than the fundamental. Negative sequence harmonics—such harmonics try to make the motor run slower than the fundamental. In both cases the motor loses torque and heats up. Harmonics can also cause transformers and motors to overheat. Even harmonics will disappear if waveforms are symmetrical, i.e., as equally positive and negative. Zero sequence current harmonics add in Neutral conductors. This can cause these conductors to also overheat.

Current distortion is expected in a system with non-linear loads like DC power supplies. In a typical case, when the current distortion starts to cause voltage distortion (THD) of more than 5%, this signals a potential problem.

K-factor indicates the amount of harmonic currents and can help in selecting transformers. K-factor may be considered along with apparent power (kVA) to select a replacement transformer to handle non-linear, harmonics-rich loads. K-factor is a mathematically derived value that takes into account the effects of harmonics on transformer loading and losses. Voltage and frequency should be close to the applicable nominal values: 120 V, 230 V, 480 V, 60 Hz, or 50 Hz. For example: Checking the voltages and currents to see if the power applied to a three phase induction motor is in balance. Each of the phase voltages should not differ more than 1% from the average of the three. Current unbalance should not typically exceed 10%. Voltage unbalance causes high unbalanced currents in stator windings, resulting in overheating and reduced motor life. If unbalance is too high, other correction modes may be used to further adjust with the use of the heretofore described present invention EBU (Energy Bank Unit) system in the power system.

Typically, crest factor close to 2.0 indicates high distortion. A pure sine wave would have a crest factor of 1.414. Anything higher is a result of distortion in the lines and feeding also back to the incoming power source this is also maintained with the EBU system installed.

Dips (sags) and swells may indicate a weak power distribution system. In a weak system, voltage will change considerably when a big motor or a welding machine is switched on or off. This may cause lights to flicker or even show visible dimming. It can also cause reset and data loss in computer systems and process controllers. By monitoring the voltage and current trend at the power service entrance, it is possible to determine if the cause of the voltage dip is inside or outside the building. The cause is inside the building (downstream) when voltage drops while current rises; it is outside (upstream) when both voltage and current drop. The final storage of the present invention corrects this problem.

Transients in a power distribution system can cause many types of equipment to malfunction. Equipment subjected to repeated transients can eventually fail Events occur intermittently, making it desirable to monitor the system for a period of time to locate them. Voltage transients can be monitored when electronic power supplies are flailing repeatedly or if computers reset spontaneously. To isolate the fault location, it is possible to use the transients function and monitor at several points in the distribution. Working down the line, circuits can be eliminated that don't show events where as further monitoring should be initiated for circuits that show the event in sharper detail. The sharper the event, the closer to identify the load causing the problem and as the unit monitoring will also isolate this allowing determination if it is a single, dual or three phase load causing the problem, further reducing the number of culprits in the building.

The voltages and currents in the Unbalance table can be used to check if applied power is in balance; for example, on a three phase induction motor. Voltage unbalance causes high unbalanced currents in stator windings, resulting in overheating and reduced motor life. Each of the phase voltages should not differ more than 1% from the average of the three. Current unbalance should not exceed 10%. If unbalance is too high, the use of the present invention will act as a stabilizer to the power system. Each phase voltage or current can be split into three components: positive sequence, negative sequence, and zero sequence. The positive sequence is the normal component present in balanced 3-phase systems. The negative sequence results from unbalanced phase-to-phase currents and voltages. For instance, this component causes a 'braking' effect in three phase motors, resulting in overheating and life reduction. Zero sequence may appear in an unbalanced load in 4 wire power systems and represents the current in the N (Neutral) wire. Unbalance exceeding 2% is considered too high Inrush is the large spike most commonly caused by a motor load coming on-line. As it first energizes, the motor utilizes a higher amount of current than when runs at a constant speed. This large current draw frequently causes a large enough voltage dip to send other equipment off-line or cause the lights to blink. The inrush is capped with the present invention and allows the inrush magnitude along with the length of time it takes the motor to come up to speed. If the inrush exceeds the breaker setting, it nominally will trip but the present invention will stabilize the problem and the storage in the device will hold the power for a much longer time for the correction of this problem.

Although particular embodiments of the invention have been described in detail herein with reference to the accompanying drawings, it is to be understood that the invention is not limited to those particular embodiments, and that various changes and modification may be effected therein by one skilled in the art without departing from the scope or spirit of the invention as defined in the appended claims.

What is claimed is:

1. A system for managing electrical consumption, which comprises:

a.) Connecting means for connection to an incoming power supply of a facility, for connection in parallel, including a hot line and a neutral line, and at least one ground, and having the following components connected between said hot line and said neutral line, in the following order;

b.) at least one front capacitor of predetermined capacitance;

c.) at least one front arc suppressor;

d.) at least one front metal oxide varistor line transient voltage surge suppressor having a predetermined number of joules capability to suppress undesired power spikes;

e.) at least two inductor/metal oxide varistor iterative transformers;

f.) at least a second capacitor of its own predetermined capacitance;

g.) at least one metal oxide varistor having a predetermined humor of joules capability;

h.) at least two capacitors, each having its own predetermined capacitance different from one another;

wherein said at least two inductor/metal oxide varistor iterative transformers include a dual iterative transformer having:

I.) a first circular magnetic coil core;

II.) a second circular magnetic coil core;

III.) a first incoming wire being wrapped in a first plurality of windings around approximately half of said first circular magnetic coil core and then traversing a predetermined distance between and to said second circular magnetic coil core and then being wrapped in a second plurality of windings around approximately half of said second circular magnetic coil core and continuing away from said second circular magnetic coil core;

IV.) a second incoming wire being positioned along one half of the external periphery of said first circular magnetic coil core and under said first plurality of windings of said first incoming wire, and then passing linearly to said second circular magnetic coil core and then being wrapped in a first plurality of windings around approximately half of said second circular magnetic coil core away from and opposite said first incoming wire second plurality of windings, and then linearly returning to said first circular magnetic coil core and being wrapped in a second plurality of windings around approximately half of said first circular magnetic coil core away from and opposite said first plurality of windings of said first incoming wire, and then being wrapped in a third plurality of windings around said first incoming wire away form and between said first circular magnetic coil core and said second circular magnetic coil core, and then being positioned along one half of the external periphery of said second circular magnetic coil core under said first incoming wire second plurality of windings.

2. The system for managing electrical consumption device of claim 1 wherein said at least one front metal oxide varistor is a plurality of varistors in parallel.

3. The system for managing electrical consumption of claim 1 wherein said at least one metal oxide varistor is a plurality of varistors in parallel.

4. The system for managing electrical consumption of claim 1 wherein said at least one capacitor is a plurality of capacitors having different capacitances.

5. The system for managing electrical consumption of claim 1 wherein said components are arranged for operating as a single phase device.

6. The system for managing electrical consumption of claim 1 further including the following components:

i.) at least one resistor having a predetermined resistance.

7. The system for managing electrical consumption of claim 1 wherein said components are duplicated to create two connected sets thereof and are arranged for operation as a two phase device.

8. The system for managing electrical consumption of claim 7 further including the following components:

i.) at least one resistor having a predetermined resistance.

9. The system for managing electrical consumption of claim 1 wherein said components are triplicated therein to form three connected sets thereof and are arranged as a three phase device, and further wherein each set of said triplicated components last at least two capacitors is at least three capacitors, each having its own predetermined capacitance different from one another.

10. The system for managing electrical consumption of claim 9 further including the following components:

i.) at least one resistor having a predetermined resistance.

11. A dual iterative transformer, which comprises:

a.) a first circular magnetic coil core;

b.) a second circular magnetic coil core;

c.) a first incoming wire being wrapped in a first plurality of windings around approximately half of said first circular magnetic coil core and then traversing a predetermined distance between and to said second circular magnetic coil core and then being wrapped in a second plurality of windings around approximately half of said second circular magnetic coil core and continuing away from said second circular magnetic coil core;

d.) a second incoming wire being positioned along one half of the external periphery of said first circular magnetic coil core and under said first plurality of windings of said first incoming wire, and then passing linearly to said second circular magnetic coil core and then being wrapped in a first plurality of windings around approximately half of said second circular magnetic coil core away from and opposite said first incoming wire second plurality of windings, and then linearly returning to said first circular magnetic coil core and being wrapped in a second plurality of windings around approximately half of said first circular magnetic coil core away from and opposite said first plurality of windings of said first incoming wire, and then being wrapped in a third plurality of windings around said first incoming wire away form and between said first circular magnetic coil core and said second circular magnetic coil core, and then being positioned along one half of the external periphery of said second circular magnetic coil core under said first incoming wire second plurality of windings.

12. The dual iterative transformer of claim 11 wherein said first circular magnetic coil core and said second circular magnetic coil core are toroids of equal size.

13. The dual iterative transformer of claim 11 wherein said second incoming wire, after its first plurality of windings and before its second plurality of windings, is semi-circularly positioned atop said first plurality of windings of said first incoming wire first plurality of digs.

14. The dual iterative transformer of claim 11 wherein said first incoming wire is a black or colored wire having an inductance within the range of 1.0 to 1.1 millihenries, plus or minus five percent and the second incoming wire is a white wire having an inductance of about 1.05 millihenries, plus or minus ten percent.

15. The dual iterative transformer of claim 11 wherein said first incoming wire and said second incoming wire are 10 to 6 gauge wires.

16. A device for multiple dual iterative transformers, which comprises a main housing having a plurality of bins, each of said plurality of bins having a dual iterative transformer including:

a.) a first circular magnetic coil core;

b.) a second circular magnetic coil core;

c.) a first incoming wire being wrapped in a first plurality of windings around approximately half of said first circular magnetic coil core and then traversing a predetermined distance between and to said second circular magnetic coil core and then being wrapped in a second plurality of windings around approximately half of said second circular magnetic coil core and continuing away from said second circular magnetic coil core;

d.) a second incoming wire being positioned along one half of the external periphery of said first circular magnetic coil core and under said first plurality of windings of said first incoming wire, and then passing linearly to said second circular magnetic coil core and then being wrapped in a first plurality of windings around approximately half of said second circular magnetic coil core away from and opposite said first incoming wire second plurality of windings, and then linearly returning to said first circular magnetic coil core and being wrapped in a second plurality of windings around approximately half of said first circular magnetic coil core away from and opposite said first plurality of windings of said first incoming wire, and then being wrapped in a third plurality of windings around said first incoming wire away form and between said first circular magnetic coil core and said second circular magnetic coil core, and then being positioned along one half of the external periphery of said second circular magnetic coil core under said first incoming wire second plurality of windings;

Said plurality of bins having divider walls between each of said dual iterative transformers that includes a conductive metal plate having opposite sides covered with a non-conductive material.

17. The system for managing electrical consumption of claim 16 wherein said divider walls include grounded aluminum plates.

18. The system for managing electrical consumption of claim 17 wherein said non-conductive materials are composite deck boards.

19. The system for managing electrical consumption of claim 18 wherein said divider walls include a grounded aluminum plate sandwiched between insulative composite deck boards wherein each insulative composite deck board is about $1/16^{th}$ to $3/16^{th}$ inches thick.

* * * * *